US006491413B1

(12) United States Patent
Benesohn

(10) Patent No.: US 6,491,413 B1
(45) Date of Patent: Dec. 10, 2002

(54) HIGH VOLTAGE (LINE) UNDER-CABINET LIGHTING FIXTURE

(75) Inventor: Sandford H. Benesohn, Beverly Hills, CA (US)

(73) Assignee: LUSA Lighting International, Valencia, CA (US)

( * ) Notice: Subject to any disclaimer, the term of this patent is extended or adjusted under 35 U.S.C. 154(b) by 0 days.

(21) Appl. No.: 09/628,749

(22) Filed: Jul. 31, 2000

(51) Int. Cl.[7] ..... F21V 29/00

(52) U.S. Cl. ..... 362/294; 362/373; 362/364; 362/345

(58) Field of Search ..... 362/133, 147, 362/294, 345, 364, 365, 373, 374, 375, 404

(56) References Cited

U.S. PATENT DOCUMENTS

| | | | | |
|---|---|---|---|---|
| 5,097,400 A | * | 3/1992 | Cvek | 362/345 |
| 5,394,316 A | * | 2/1995 | Holbrook et al. | 362/294 |
| 5,400,231 A | * | 3/1995 | Huang | 362/294 |
| 5,909,955 A | | 6/1999 | Roorda | 362/368 |

OTHER PUBLICATIONS

Evolution Minilites Collection brochure, 1900 N. Andrews Ave, Ext., Suite C, Pompano Beach FL 33069 (undated).

Outwater Hardware Catalog pp. 154,155; Outwater Hardware Corporation, 11 West End Road, Totowa, NJ 07512 (1998).

Laura & Honnelore Co., Ltd flyer in GES Lightning Review Catalog, Oct. 1998.

Home Lightning and Accessories, Disc Light, Apr. 1996, p. 133.

Lightning Concepts, Outwater Plastic Industries, Inc., 4 Passaic Street, PO Drawer 403, Wood–Ridge, NJ 07075 (undated).

* cited by examiner

*Primary Examiner*—Y. My Quach-Lee
(74) *Attorney, Agent, or Firm*—Baker, Donelson, Bearman & Caldwell

(57) ABSTRACT

A high voltage under-cabinet lighting fixture having a housing suitable for recess mounting engageable to a can for surface mounting, which housing as an open end opposing a base having at least a thickened portion and a plurality of slotted openings therein. A reflector having a dished cavity seats on projections extending from the open end of the housing to define a gap between the reflector and the housing. A lamp socket is received in the housing to dispose a lamp substantially in alignment with the thickened portion of the base. A insulated pad is disposed between the reflector and the thickened portion of the base. A cap defining a plurality of space-apart ports includes a transparent sheet for communicating light from the light fixture. The cap is received on the housing which thereby defines a pathway for communicating air through the ports, the gap, and the openings to flow about and past the reflector for communicating heat from the reflector to ambient air past the surface to which the housing mounts.

22 Claims, 3 Drawing Sheets

HIGH VOLTAGE (LINE) UNDER-CABINET LIGHTING FIXTURE

TECHNICAL FIELD

The present invention relates to under-cabinet lighting fixtures. More particularly, the present invention relates to high voltage under-cabinet lighting fixtures which are readily installed to provide bright lighting with controlled and limited transfer of heat to mounting surfaces.

BACKGROUND OF THE INVENTION

Lights and lighting not only provide useful general illumination of interior and exterior spaces in homes and buildings, but also provide ornamental and artistic treatments for decorative purposes. These purposes include lighting functions as well as highlights for artwork, for accent and interior ornamental design functions, and other functions. Often furniture or cabinetry have lights for illuminating articles held within the furniture or cabinets. For cabinets, and in particular kitchen wall cabinets, lighting fixtures are often mounted to a lower exterior surface or recessed therein, for providing lighting to countertop surfaces below the cabinets. In a "recess" application, a cavity within a shelf receives the light fixture. The lighting fixture thereby has a reduced profile outwardly of the mounting surface.

One type of lighting fixture is known as an under-cabinet puck light. These lights are generally cylindrical disc-shaped housings. The housings contain a reflector, a lamp socket with a light emitive bulb, and a glass lens for transmitting light from the housing to the countertop surface below the cabinet. The socket connects to a supply of electrical current.

Under-cabinet puck lights originated in the European lighting market a number of years ago by primarily German and Italian manufacturers. These under-cabinet puck lights included transformer devices to provide 12 volt direct current for illuminating the light bulbs. The transformer connects to line voltage, which in Europe is 220 volt alternating current, to provide the electrical current for operating the lights at the stepped-down voltage. Generally, a plurality of the under-cabinet puck lights connect by electrical wires to the transformer. These lighting systems were known as low voltage systems, due to operation with the stepped-down direct current of 12 volts from the transformer.

Such low voltage direct current lighting systems provide a number of advantages. The light housings and transformers are installed by connecting the transformer directly to the line current and then using wiring to connect the lights to the transformer. Because the current was low voltage, the connections of the wiring do not require special electrical junction boxes. Also, special conduit is generally not required for the wiring, and the wiring may be exposed, although preferably the wiring is placed at side edges of the shelf or other support surface to which the lighting fixture was attached. Further, the low voltage lights generate little heat. Accordingly, these low voltage under-cabinet puck lights are appropriate for use mounted to wooden surfaces under kitchen cabinetry or recessed into shelf portions of cabinets. The lights provide several pools of lights to the countertop surface, and are used typically in kitchens and display cabinetry for providing light on the working surfaces in kitchens as well as for use in highlighting articles in display cabinets.

While the under-cabinet puck lights provide light to work areas, the brightness of the illuminative effect has not been entirely satisfactory. In response, Lusa Lighting of Los Angelos, Calif., developed a low-voltage puck lighting system using halogen bulbs. Halogen bulbs provide a significantly higher light output per watt as compared to conventional incandescent bulbs. Low voltage under-cabinet halogen light systems use the low voltage components discussed above. These systems have a maximum of approximately 20 watts per lighting fixture installed in surface mount or recessed mount applications.

The low voltage halogen lights are generally powered by electronic transformers which function on the low side at 12 volts direct current output and on the high side with 120 volts alternating current input, for use in the United States. Use of transformers however is not entirely satisfactory. Transformers are subject radio frequency interference which may cause lights to flicker or dim. Transformers are generally bulky and require special mounting. The total combined wattage of the lamps operated by the transformer cannot exceed the output of the transformer. Also, many electronic transformers do not deliver the full rated wattage to the lamps. As the distance increases between the lamp and the transformer, the lumen output decreases. In response, lighting systems that use high voltage, 120 volt alternating current has been developed. Generally 120 volt systems do not limit the number of lamps used in an application. Lumen output from the lamps remains constant, independent of the length of the electrical cord. Lamps operated on an 120 volt system receive full wattage capacity. Single lights are readily installed with standard plug and switches and do not require separately provided transformer. These systems however require steel housings to accommodate the increased heat emitted by the lamps operating at high-current, line voltage. These lighting fixtures require surface mounting, and are not designed to be incorporated into recess-mounted applications. The high voltage systems therefore eliminated the transformer requirement for under-cabinet lighting, but the heat generated by the lamps at line voltage limited the applications for use. Further, high voltage light bulbs typically had threaded bases for engaging screw sockets. These sockets are bulky in size and generally impractical for the smaller under-cabinet puck type fixture. Small bulbs using line voltage also had relatively limited life, and typically required replacement more frequently than do the low voltage bulbs.

Accordingly, there is a need in the art for an under-cabinet lighting fixture for surface and recessed mounting and operating on high line voltage for increased illumination with controlled transfer of the heat communicated therefrom. It is to such that the present invention is directed.

BRIEF SUMMARY OF THE PRESENT INVENTION

The present invention provides an under-cabinet lighting fixture for surface and recessed mounting and operating on high line voltage for increased illumination with controlled transfer of the heat communicated therefrom, with a housing that defines an open end opposing a base having a thickened portion. The housing defines a plurality of openings in the base, and a plurality of projections extending from an edge of the housing. A reflector defining a dished cavity seats on the projections to define a gap between the reflector and the housing. A lamp socket received in the housing engages a lamp bulb that is substantially in alignment with the thickened portion of the base and disposed in the dished cavity. A cap received on the housing has a plurality of spaced-apart ports. The high voltage lighting fixture defines a pathway for communicating air through the ports, the gap, and the openings, past the reflector for communicating heat from the reflector to ambient air.

Objects, advantages, and features of the invention will be come apparent upon a reading of the following detailed description of the present invention in conjunction with the drawings and the appended claims.

DETAILED DESCRIPTION OF THE PREFERRED EMBODIMENTS

Figure 1:
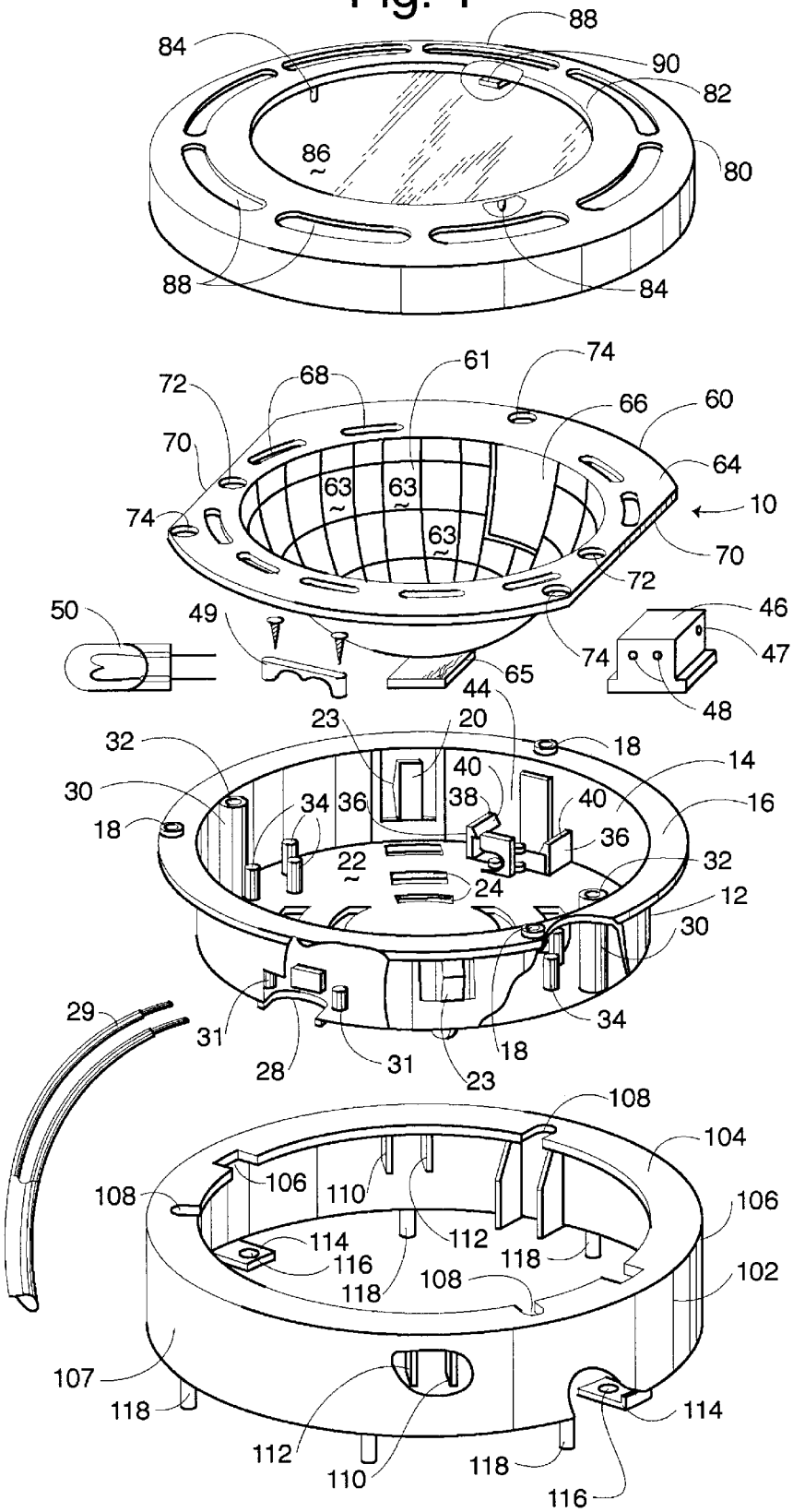
FIG. 1 is an exploded perspective view of a lighting fixture according to the present invention.

Referring now in more detail to the drawings in which like parts have like identifiers, FIG. 1 illustrates in exploded perspective view a high voltage light fixture 10 according to the present invention. The light fixture 10 in the illustrated embodiment is adapted for mounting as an under-cabinet lighting fixture or for recessed mounting in a cabinet, as discussed below. The light fixture 10 comprises a housing 12 having an open end 14 with a flange 16 extending laterally therefrom. Three posts 18 extend from a first surface of the flange 16. A pair of opposing tabs 20 are defined in the side wall of the housing 12. The tabs 20 are engaged at a first end to the housing 12 for flexible movement relative to the housing, for a purpose discussed below. The tabs 20 include an outwardly extending tip 23.

Figure 2:
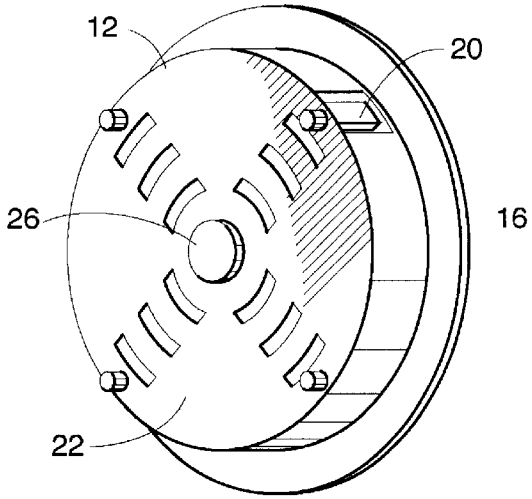
FIG. 2 is a perspective bottom view of the housing for the light fixture shown in FIG. 1.

The housing 12 defines a partially closed bottom 22 having a plurality of openings 24. In the illustrated embodiment, the openings 24 are aligned slots defining concentric rings arranged radially. A central portion 26 defines a thickened portion of the bottom 22, as best illustrated in FIG. 2 In a preferred embodiment, the thickened portion 26 extends 0.06 inches from the surface of the bottom 22, to approximately double the thickness of the wall of the housing 12 in the central portion 26. A slot 28 is defined in the side wall of the housing adjacent the bottom 22 for receiving a pair of electric wires 29. A pair of lugs 31 extend upwardly from opposing sides of the slot 28. A pair-of posts 30 extend from opposing sides of the slot 28. A pair of posts 30 extend from the open end 14 to the bottom 22 on opposing sides of the housing 12. The posts 30 each define a bore 32 extending along a longitudinal axis of the post. Studs 34 extend from the bottom 22 and are spaced-apart from each of the respective posts 30.

A pair of tabs 36 extend upwardly from the bottom 22. Each tab 36 defines an angled hook 40 at a distal end 38. A plate 42 extends upwardly from the bottom 22. The plate 42 is disposed radially inwardly from the side wall of the housing and between the tabs 36. The tabs 38, the plate 42, and a portion of the housing 12 cooperatively define a recess 44 for receiving a lamp socket 46. The lamp socket 46 defines side openings 47 for receiving the ends of the electrical wires and lamp post sockets or openings 48 for engaging a lamp 50. The socket 46 is specially configured to permit using bulbs for 120 volt applications, but not bulbs for low voltage application. The light bulb 50 is a halogen 120 volt type T-4 glass shaped bulb with a type G-8 lamp base, and is rated to provide over 1,000 hours.

The present invention accordingly provides a halogen T-4 shaped bulb of about 20 watts with a limiting G-8 lamp base for 120 volt applications. In this way, low volt bulbs of a T-4 type are excluded from use in the fixture 10 of the present invention. A U-shaped brace 49 defines a pair of opposing holes at distal ends. The brace 49 is received by the lugs 31 with screws entering the lugs 31 through the holes for securing the electrical wires 29 in the slot 28.

The lighting fixture 10 includes a reflector 60. The reflector 60 preferably is a stamped aluminum member defining a dish-shaped cavity 61 with a laterally extending flange 64. The reflector 60 seats on the three posts 18 on the upper surface of the flange 16. This defines air flow pathways therebetween. In the illustrated embodiment, the face of the dish-shaped cavity 61 defines a plurality of facets 63 for reflecting light. A pad 65 of an insulative material is disposed between the thickened portion 26 and the reflector 60. An opening 66 is defined in a side of the reflector 60. The opening 66 is configured for receiving therethrough a portion of the lamp socket 46. The flange 64 defines a plurality of openings 68 at an edge of the cavity 61. In the illustrated embodiment, the openings are elongate slots. The flange 64 defines a pair of opposing flats 70 each with an adjacent opening 72. Also, in the illustrated embodiment, three other openings 74 are defined in the flange 64. The openings 74 are spaced-apart uniformly on a perimeter edge portion of the flange 64.

A cap 80 closes the housing 12. The cap 80 defines a central opening 82. A plurality of fingers 84 extend from an inner surface of a cap adjacent the central opening. The fingers 84 preferably angle towards the opening 82. The fingers 84 cooperatively engage a glass lens 86. In the illustrated embodiment, the glass lens is a UV filter for reducing emissions from halogen light bulbs preferably used with the lighting apparatus 10. A plurality slot-like of openings 88 are defined in the cap 80. A pair of ears 90 extend radially inwardly from a skirt of the cap 80 on opposing sides.

The lighting fixture described above is particularly useful for recessed mounting in cabinets, as discussed below. Also illustrated in FIG. 1 is a surface can 100 for surface mounting of the fixture 10. The can 100 defines an annular ring 102 having an inwardly extending flange 104. A pair of opposing notches 106 are defined in the flange 104. Further, the three arcuate slots 108 are defined in the flange 104. The slots 108 align with the openings 74 in the reflector 60 for a purpose discussed below. Off-set from the notches 106 are two pairs of opposing side flanges 110, 112. A pair of opposing shoes 114 extend radially towards each other from a lower edge of the side wall of the ring 102. Each shoe 114 defines an opening 116. A plurality of pins 118 extend from the ring 102 opposing the flange 104. The shoe 114 and the pins 118 space the can 100 from a surface to which the can 100 mounts and defines airflow pathways between the light fixture 10 and the surface. An alternate embodiment does not include the pins 118, but defines a plurality of spaced-apart holes in the side wall 107 for airflow out of the can 100.

Figure 6:
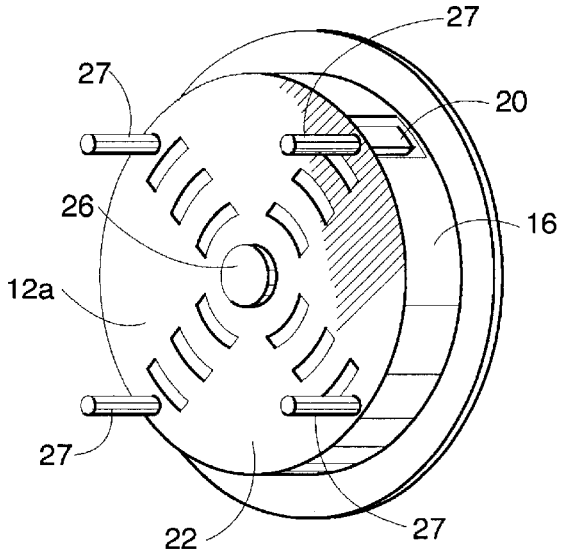
FIG. 6 is a perspective bottom view of the housing for the light fixture shown in FIG. 5.
Figure 5:
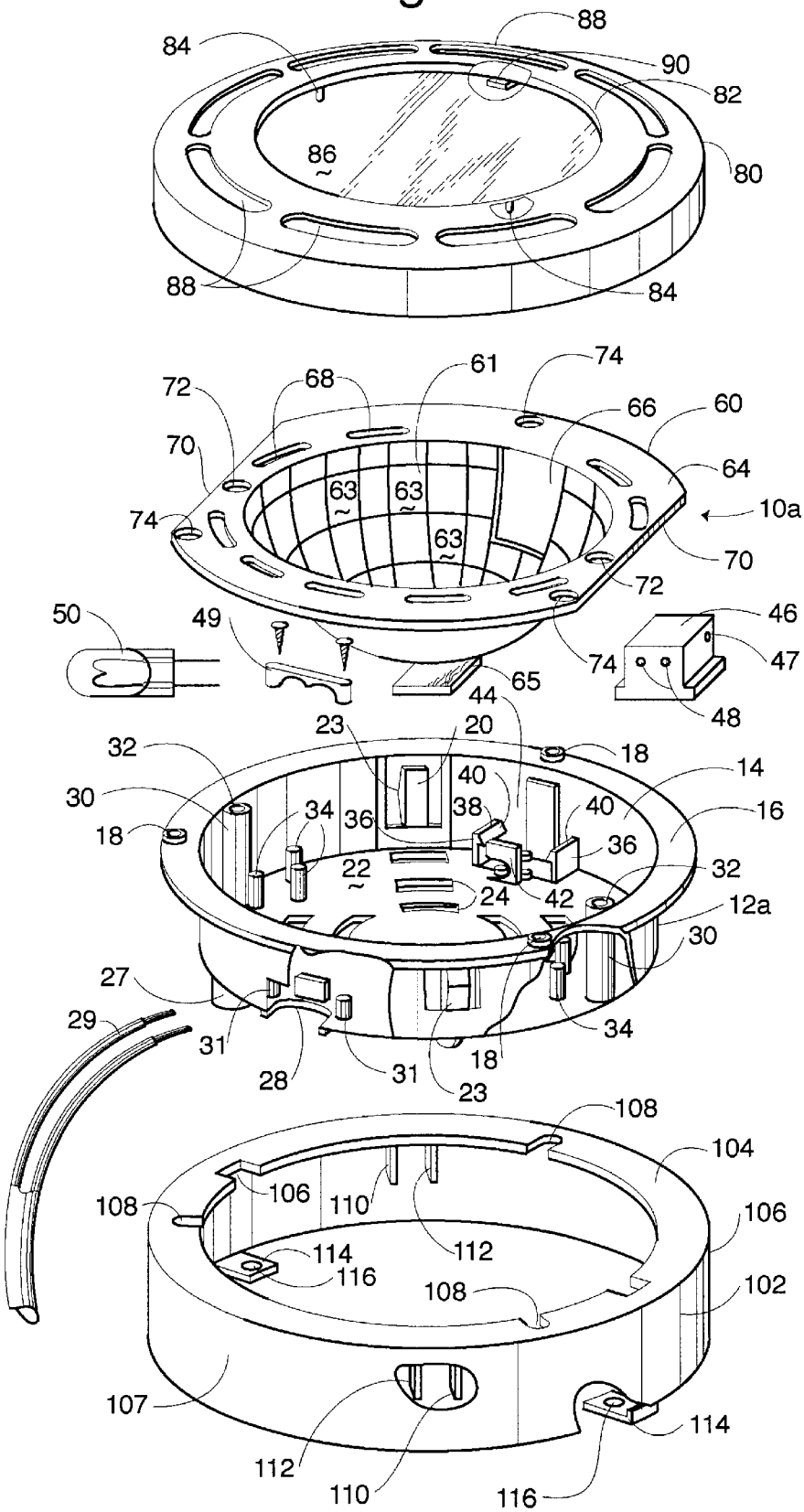
FIG. 5 is an exploded perspective view of an alternate embodiment of a lighting fixture according to the present invention.

FIG. 5 is an exploded perspective view of a lighting fixture 10*a* according to the present invention, and FIG. 6 is a perspective bottom view of a housing 12*a* for the light fixture 10*a*. In this embodiment, a plurality of legs 27 extend outwardly from the bottom 22. The surface can 100*a* does not include the pins 118. Rather, the legs 27 extending from the housing 12*a* space the light fixture 10*a* from a surface to which the can 100*a* mounts. The legs 27 accordingly defines airflow pathways between the light fixture 10*a* and the surface.

Figure 3:
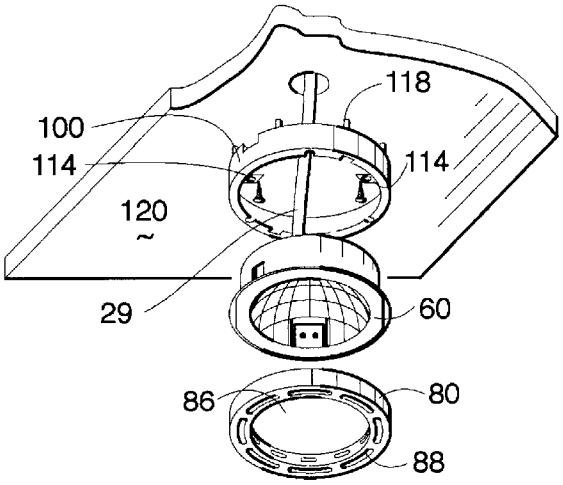
FIG. 3 is a perspective view of a surface-mounting installation of the lighting fixture shown in FIG. 1.
Figure 4:
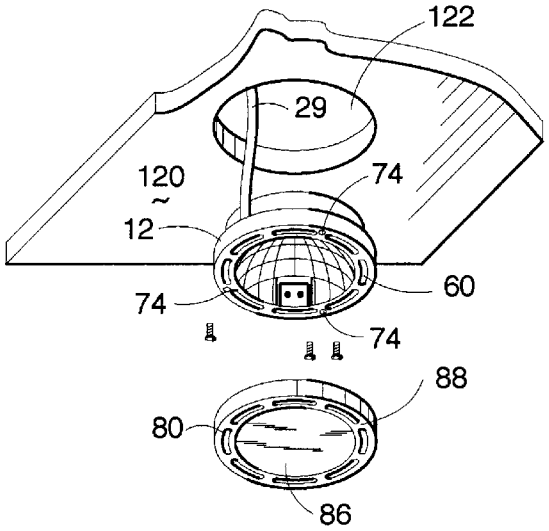
FIG. 4 is a perspective view of a recessed-mounting installation of the lighting fixture shown in FIG. 1.

FIG. 3 is a perspective view of a surface-mounting installation of the light fixture 10. In this mounting, the housing 12 is received within the can 100 and mounted with screws extending through the holes 116 in the shoes 114 to the surface 120. FIG. 4 is a perspective view of a recessed mounting installation of the recessed lighting fixture 10. In this installation, the surface can 100 is not used. Rather, the housing 12 is secured within a recess 122 in the mounting surface 120 with screws extending through the openings 74 and the aligned posts 18 in the flange 16. In both installations, the cap 80 closes the housing 12.

For use, the electric wires 29 pass through the slot 28 in the housing 12 and separate. The separate wires loop through the respective studs 34 adjacent the posts 30 on opposing sides of the housing 12. The distal ends of the electric wires 29 are electrically connected to the socket 46 through the opposing holes 47. The socket 46 is secured in the recess 44 by the tabs 36. The brace 49 is secured by screws to the lugs 31 in order to hold the electric wires 29 in the slot 28.

In the preferred embodiment, the insulative pad 65 is placed on the thickened central portion 26. The reflector 60 is inserted into the housing 12 and seats on the pad 65. A bulb, preferably a halogen bulb, is engaged to the lamp post openings 48 in the socket 46.

As illustrated in FIG. 4, the housing 12 may be installed in the annular recess 122 of the shelf 120. An appropriate sized hole is created in the selected location. The electrical wires 29 are passed through the hole. The light housing 12 is pushed into the recess. The flange 64 overlaps a portion of the shelf 120. Three screws extend through the openings 74 to secure the housing 12 in place. The cap 80 is attached to the distal end of the housing 12. This is accomplished by pushing the ears 90 past the opposing flats 70. Rotation of the cap 80 brings the ears 90 under the flange 64 to secure the cap to the flange. The free end of the electric wires 29 is connected to a source of line voltage. Preferably, the electric wires 29 connect through a switch for selectively actuating the lamp.

The lighting fixture 10 of the present invention also surface mounts as illustrated in FIG. 3 with the housing 12 received within the open end of the can 100. This is accomplished by locating a selected position for the fixture 10 on the surface 120. The electrical wires 29 in the illustrated embodiment extend through an opening in the mounting surface 120. The can 100 attaches to the surface with screws extending through the openings 116 in the opposing shoes 114. The subassembly of the housing 12 and the reflector 60 are then engaged to the surface can 100. The tabs 20 align with the flanges 110, 112. The housing 12 is pushed into the can. The tabs 20 flex and allow the housing past the flange 104. The flanges 110 and 112 receive the tabs 20 therebetween to prevent rotation of the housing 12. The free end of the electrical wires 29 are connected to a source of line voltage for powering the light fixture 10. The slots 108 in the flange 104 align with the openings 74 in the reflector 60 and the openings of the posts 18 in the housing 12. Screws through the openings and the slots secure the housing to the surface 120. The pins 118 extending from the ring 102 define airflow pathways between the light fixture 10 and the surface 120 to which the can 100 is mounted. The airflow pathway provides a thermal pathway for communicating heat from the lighting fixture 10. The cap 80 is attached as discussed above.

In the embodiment illustrated in FIGS. 5 and 6, the legs 27 extending from the bottom 22 space the light fixture 10*a* from the surface 120 to which the can 100*a* is mounted. This defines airflow pathways between the light fixture 10*a* and the surface 120. The airflow pathways provide thermal pathways for communicating heat from the lighting fixture 10*a*. The cap 80 is attached as discussed above.

In operation, the lighting fixture 10 defines thermal pathways through the cap 80, the reflector 60, and the housing 12, for communicating heat from the lighting fixture to ambient air. These pathways provide an air pathway chimney effect for transferring heat from the fixture 10 to ambient air. Air enters the lighting fixture 10 through the slot-like openings 88 in the cap 80. The air travels through the openings 68 in the reflector 60 as well as passing through the gap defined between the reflector 60 and the housing 12 by the posts 18. With the light bulb illuminated, the air becomes heated as it travels past the reflector 60. The heated air exits the housing 12 through the openings 24 in the bottom 22. For recess mounting, the heat communicates into the space above the mounting surface 120. For surface mounting, the heat communicates outwardly of the housing along the surface 120 through the gaps or pathways defined by depending members which in the illustrated embodiment are the pins 118 (or in the alternate embodiment, by the legs 27). In an alternate embodiment, the heated air communicates through holes in the side walls of the housing 12 and the can 100. In this manner, the high-voltage lighting fixture 10 of the present invention provides controlled transfer of the heat communicated by the lamp in the under-cabinet lighting fixture 10.

A lighting fixture according to the present invention was subjected to temperature testing pursuant to UNDERWRITERS LABORATORY Test 153, section 101 $11^{th}$ edition. In this test, temperature readings were obtained by thermocouples consisting of wires not larger than No. 24 AWG (0.21 $mm^2$). The thermocoupled junction and adjacent thermocouple lead wire were held securely in thermal contact with the surface of the material for which the temperature was being measured, as listed below in Table 2. The thermocouples were placed at locations of the hottest accessible parts. The thermocouples were secured to surfaces by welding, soldering, fullers earth, and sodium silicate (waterglass), adhesive suitable for surface and temperatures, or equivalent, so that good thermal contact was maintained. Tape was not used to secure the thermocouple within 3 inches (76.2 cm) of the thermocouple junction.

For units using polymeric parts such as a thermal plastic enclosure, temperatures were measured by placing one or more thermocouples in contact with a part in such a manner that a thermocouple was wedged between the part and any metallic material or other source of conducted heat. For a source of radiated or convected heat, thermocouples were inserted from outside surfaces through holes drilled in the polymeric material, such that the thermocouple tips were placed near the plane of the inside surface and sealed in place with fuller's earth and sodium silicate (waterglass).

The ambient temperature was measured by means of a thermocouple immersed in a bath of 15 ml of mineral oil in a glass container. The oil bath was placed at the same level as the horizontal plane formed by a line that passed through the fixture half-way down its vertical length and at least 3 fixture diameters from the fixture horizontally. The test was conducted in ambient temperature of 25±5° C. (77±9° F.).

In the test, a portable lamp was operated continuously at rated lamp wattage until consistent temperatures were obtained. A temperature was considered consistent if the test was running at least three hours and three successive readings taken at 30-minute intervals were within 1° C. of one another and still not rising. This indicated no change. The first reading was taken no sooner than three and one-half hours after beginning the test.

The light fixture was tested in a six-sided box having inside dimensions of 12 inches by 12 inches by 12 inches. The test box was made of one-half inch (12.7 mm) plywood or particle board, with one-eighth inch (3.2 mm) thick glass front. All seams were sealed with tape or equivalent to restrict air exchange.

The cabinet light was mounted as close to the sides and top of the test box as the housing or shade provided or the cabinet light permits, and operated until all temperatures stabilized. The mounting means accommodated more than one mounting configuration and the test was conducted in the condition representing the most severe operation.

Two test were conducted and are reported below. In test A, the light fixture was surface mounted. In test B, the light fixture was recessed mounted.

TABLE 1

TEST PERIMETERS
The following reports the test perimeters for the light fixture using a type G4, 20 watt test lamp.

| TEST | VOLTAGE (v) | AMPERAGE (a) | WATTAGE (w) |
|---|---|---|---|
| A. | 123.3 | 0.17 | 20.2 |
| B. | 124.7 | 0.17 | 20.4 |

Table 2 below reports the measured temperature of the thermocouples at various locations relative to the light fixture and the test box.

TABLE 2

Thermocouple Location And Measured Temperatures

| THERMOCOUPLE LOCATION | TEMPERATURE (° C.) Test A | Test B |
|---|---|---|
| Ambient | 24.9 | 25.6 |
| Lampholder (LH) body | 163.9 | 154.2 |
| Lead ¼ from lampholder | 130.9 | 114.2 |
| Between reflector and enclosure | 135.0 | 112.1 |
| Inside plastic enclosure directly above lamp | 106.5 | 84.7 |
| Between LH and enclosure | 126.0 | 109.4 |
| Reflector where wire and can contact | 139.4 | 132.9 |
| On plastic edge of enclosure that can contacts wood | N/A | 77.7 |
| Between lens frame and plastic trim ring | 149.2 | 130.8 |
| Center top of enclosure | 98.5 | 73.2 |
| Cord were enters enclosure | 96.7 | 78.6 |
| Strain relief clamp | 110.6 | 98.3 |
| Mounting surface | 87.2 | N/A |
| Enclosure in contact w/mounting ring | 112.3 | N/A |

In order to pass, no surface in contact with the lighting fixture could experience temperatures in excess of 90° C. Based on the results of this test, the under-cabinet lighting fixture of the present invention passed.

A second test was conducted to evaluate the dielectric voltage-withstand capacity for the under-cabinet light fixture. In this test, a 40–70 hertz potential of 1200 volts was applied for one minute between the primary wiring, including connected components and accessible dead-metal parts that would likely to become energized, including those parts that were accessible only during re-lamping (and primary wiring and accessible low voltage 42.4 volt peak or less metal part including terminals). The result of this test shows that the lamp withstood the application of the test potential without breakdown for one minute.

It is noted that embodiments of the present invention that lack the central thickened portion 26 of the base, the pad 65 of insulated material, and the air flow channels through and about the reflector, while providing high voltage lighting fixtures, also experienced heat transfer to mounting surfaces which exceeded test limits. However, an embodiment that lacked the pads 65 experienced a temperature slightly over the test standards as shown below in Table 3.

TABLE 3

Fixture Without Insulative Pad
TEST A

| THERMOCOUPLE LOCATION | TEMPERATURE ° C. |
|---|---|
| Ambient | 25.0 |
| Mounting Surface | 89.0 |
| Mounting Surface | 87.8 |
| Mounting Surface | 90.4 |
| Mounting Surface | 89.1 |

The present invention accordingly provides a high voltage lighting system which controls the communication of heat to mounting surfaces through chimney air flow ventilation from the cap 80, through and about the reflector 60, and exiting from the back adjacent the mounting surface, with the central thickened portion 26, and in some embodiments, insulative pads 65 between the base 22 and the reflector 60. Accordingly, the present invention provides line-voltage lighting fixtures particularly suited for under-cabinet installations. The principles, preferred embodiments, and modes of operation of the present invention have been described in the foregoing specification. The invention is not to be construed as limited to the particular forms disclosed as these are regarded as illustrative rather than restrictive. Moreover, variations and changes may be made by those skilled in the are without departing from the spirit of the invention described in the following claims.

What is claimed is:

1. A high voltage under-cabinet lighting fixture, comprising:

a housing defining an open end that opposes a base having at least a thickened portion, the base defining a plurality of openings in a portion opposing the open end, and a plurality of projections extending from an edge of the housing at the open end;

a reflector defining a dished cavity and seating on the projections to define a gap between the reflector and the housing;

a lamp socket received in the housing with a lamp bulb engaged to the lamp socket, the lamp bulb in alignment with the thickened portion of the base; and a cap received on the housing, the cap having a plurality of spaced-apart ports, whereby the lighting fixture defines a pathway for communicating air through the ports, the gap, and the openings, for air to flow past the reflector for communicating heat from the reflector to ambient air.

2. The high voltage under-cabinet light fixture as recited in claim 1, further comprising an insulating pad received within the housing in alignment with the thickened portion.

3. The high voltage under-cabinet light fixture as recited in claim 1, wherein the openings are defined in the base.

4. The high voltage under-cabinet lighting fixture as recited in claim 3, further comprising an open-ended can for receiving the housing through one end of the can and defining a plurality of pins extending outwardly from the can to define a gap between the can and a surface to which the can is mounted.

5. The high voltage under-cabinet light fixture as recited in claim 1, further comprising a recess in a side of the housing for matingly receiving the socket.

6. The high voltage under-cabinet light fixture as recited in claim 5, wherein the reflector defines a slot for receiving the socket by seating the reflector on the open end of the housing, the socket extending through the slot inwardly of the cavity defined by the reflector for receiving the lamp bulb therein.

7. The high voltage under-cabinet light fixture as recited in claim 1, further comprising an open-ended can for receiving the housing through one end and defining a plurality of pins extending outwardly from the can to define a gap between the can and a surface to which the can is mounted.

8. The high voltage under-cabinet light fixture as recited in claim 1, wherein the reflector defines a plurality of openings therein for communicating air from the ports in the cap to the openings in the base of the housing, for carrying heat from the reflector out of the fixture.

9. The high voltage under-cabinet as recited in claim 1, wherein the cap defines a central opening configured to receive a transparent sheet.

10. The high voltage under-cabinet light fixture as recited in claim 1, wherein the lamp bulb comprises a bulb portion of a low voltage shape with a base portion configured for high voltage.

11. A high voltage under-cabinet lighting fixture, comprising:

a housing defining an open end that opposes a base having at least a thickened portion;

the base defining a plurality of arcuate slots defining concentric rings spaced radially from a central portion of the base;

a plurality of projections extending from an edge of the housing at the open end;

a reflector defining a dished cavity and seating on the projections to define a gap between the reflector and the housing;

a lamp socket and a lamp received in the housing with the lamp in substantial alignment with the thickened portion of the base;

a pad of an insulative material received within the housing in substantial alignment with the thickened portion of the base; and a cap received on the housing and defining a plurality of spaced-apart ports, the cap receiving a transparent sheet to provide a cover over the lamp for communicating light therefrom; and electrical wires connected to the socket for communicating current to the lamp for lighting the lamp, whereby the lighting fixture defines a pathway for communicating the air through the ports, the gap, and the slots, for air to flow past and about the reflector for communicating heat from the reflector to ambient air.

12. The high voltage under-cabinet light fixture as recited in claim 11, wherein the lamp comprises a bulb of a low voltage shape with a base portion configured for high voltage.

13. A high voltage lighting fixture adapted for mounting to cabinetry, comprising:

a housing defining an open end that opposes a base that defines a plurality of openings;

a pad of an insulative material received within the housing on at least a portion of the base;

a reflector defining a dished cavity and seating on a plurality of projections extending from an end of the housing to define a gap between the reflector and the housing;

a lamp socket received in the housing;

a lamp received in the lamp socket and in substantial alignment with the pad of the insulative material on the base of the housing;

a cap received on the housing and defining a plurality of spaced-apart ports, the cap receiving a light transmissive sheet to provide a cover over the lamp for communicating light therefrom; and electrical wires connected to the socket for communicating current to the lamp for lighting the lamp, whereby the lighting fixture defines a pathway for communicating the air through the ports, the gap, and the openings, for air to flow past and about the reflector for communicating heat from the reflector to ambient air.

14. The high voltage lighting fixture as recited in claim 13, wherein the base further defines a thickened portion in substantial alignment with the pad.

15. The high voltage lighting fixture as recited in claim 13, further comprising an open-ended can for receiving the housing through one end of the can; and a plurality of pins extending from the other end for defining a plurality of airflow pathways between the light fixture and a surface to which the can mounts.

16. The high voltage lighting fixture as recited in claim 13, wherein the reflector defines a slot for receiving at least a portion of the socket within the cavity defined by the reflector for receiving the lamp therein.

17. The high voltage light fixture as recited in claim 13, wherein the reflector defines a plurality of openings therein for communicating air from the ports in the cap to the openings in the base of the housing, for carrying heat from the reflector out of the fixture.

18. The high voltage light fixture as recited in claim 13, wherein the cap defines a central opening and configured to receive the light transmissive sheet therein.

19. A high voltage under-cabinet lighting fixture, comprising:

a housing having an open end that opposes a base with at least a portion thicker than a wall of the housing and defining a plurality of openings in the base;

a reflector defining a dished cavity and seating on a plurality of projections extending from an edge of the housing to define an air-communicating gap between the reflector and the housing;

a socket received in the housing with a light bulb engaged to the socket, the light bulb in alignment with the thickened portion of the base; and a cap received on the housing, the cap defining a plurality of spaced-apart ports, whereby the lighting fixture defines a pathway for communicating air through the ports, the gap, and the openings, for air to flow past the reflector for communicating heat from the reflector to ambient air.

20. The high voltage under-cabinet light fixture as recited in claim 19, further comprising an insulating pad received within the housing in alignment with the light bulb.

21. The high voltage lighting fixture as recited in claim 19, further comprising an open-ended can for receiving the housing through one end of the can; and a plurality of pins extending from the other end for defining a plurality of airflow pathways between the light fixture and a surface to which the can mounts.

22. The high voltage lighting fixture as recited in claim 19, wherein the light bulb comprises a low voltage shape with a high voltage base.

* * * * *

UNITED STATES PATENT AND TRADEMARK OFFICE

CERTIFICATE OF CORRECTION

PATENT NO. : 6,491,413 B1
DATED : December 10, 2003
INVENTOR(S) : Sanford H. Benensohn It is certified that error appears in the above-identified patent and that said Letters Patent is hereby corrected as shown below:

Title page,
Item [75], change "Sandford H. Benensohn" to -- Sanford H. Benensohn --.

Signed and Sealed this

Seventh Day of October, 2003

JAMES E. ROGAN
*Director of the United States Patent and Trademark Office*